US005934995A

United States Patent [19]

Morris et al.

[11] Patent Number: 5,934,995

[45] Date of Patent: Aug. 10, 1999

[54] RIDGE CAP ROOF VENTILATOR APPLIED IN ASSEMBLED, ROLLED FORM AND METHOD OF MAKING AND INSTALLING

[75] Inventors: Richard J. Morris, Prior Lake; Gary P. Kasner, Eden Prairie; Mark Stoll, Excelsior, all of Minn.

[73] Assignee: Liberty Diversified Industries, Minneapolis, Minn.

[21] Appl. No.: 08/828,257

[22] Filed: Mar. 26, 1997

Related U.S. Application Data

[63] Continuation-in-part of application No. 08/570,656, Dec. 11, 1995, Pat. No. 5,651,734.

[51] Int. Cl.[6] ..... F24F 7/00

[52] U.S. Cl. ..... 454/365; 52/199

[58] Field of Search ..... 454/365; 52/57, 52/199

[56] References Cited

U.S. PATENT DOCUMENTS

| | | | |
|---|---|---|---|
| D. 257,282 | 10/1980 | Roberts | D23/153 |
| D. 257,283 | 10/1980 | Roberts | D23/153 |
| 3,185,070 | 5/1965 | Smith . | |
| 3,889,892 | 6/1975 | Melead | 242/527.3 |
| 3,949,657 | 4/1976 | Sells . | |
| 4,803,813 | 2/1989 | Fiterman | 52/199 |
| 4,807,409 | 2/1989 | Sells | 52/95 |
| 4,843,953 | 7/1989 | Sells . | |
| 4,942,699 | 7/1990 | Spinelli | 52/57 |
| 5,002,816 | 3/1991 | Hofmann et al | 454/365 |
| 5,054,254 | 10/1991 | Sells | 52/199 |
| 5,092,225 | 3/1992 | Sells | 454/365 |
| 5,094,041 | 3/1992 | Kasner et al. | 52/57 |
| 5,099,627 | 3/1992 | Coulton et al. | 52/408 |
| 5,304,095 | 4/1994 | Morris | 454/365 |
| 5,328,407 | 7/1994 | Sells | 454/365 |
| 5,331,783 | 7/1994 | Kasner et al. | 454/365 X |
| 5,427,571 | 6/1995 | Sells | 454/365 |
| 5,439,417 | 8/1995 | Sells | 454/365 |
| 5,542,882 | 8/1996 | Sells | 454/365 |
| 5,603,657 | 2/1997 | Sells | 454/359 |
| 5,673,521 | 10/1997 | Coulton et al. | 454/365 X |

*Primary Examiner*—Harold Joyce
*Attorney, Agent, or Firm*—Patterson & Keough, P.A.

[57] ABSTRACT

A ridge vent comprising a pair of opposing vent parts each fabricated from a plurality of stacked, interconnected layers of a corrugated plastic sheet material and a top panel extending between and connected to the opposing vent parts, with the entire assembled ridge vent being rolled into a spiral or coil, and secured in that configuration for later installation on a roof. The assembled ridge vent is rolled into the spiral configuration from an initially planar configuration by engaging a leading end of the ridge vent and rolling the ridge vent onto a drum or mandrel to form a tight, uniform spiral. The rolled vent can then be labeled and banded or packaged. The fabrication process from bulk rolls of sheet material to packaged roof vents can be substantially continuous and automated. Roof vents of various lengths or widths can be manufactured with only minor adjustments or substitutions in the fabrication equipment. The ridge vent is installed by placing the roll on the peak of the roof with the free end of the spiral extending over the top of the spiral and oriented away from the direction of installation. The blank is unrolled to expose a portion of the ridge vent, which is fastened to the roof. This process is repeated until the desired length is installed. Foam end caps and air deflectors optionally may be installed.

62 Claims, 3 Drawing Sheets

RIDGE CAP ROOF VENTILATOR APPLIED IN ASSEMBLED, ROLLED FORM AND METHOD OF MAKING AND INSTALLING

RELATED APPLICATIONS

This is a continuation-in-part of application Ser. No. 08/570,656 filed on Dec. 11, 1995, U.S. Pat. No. 5,651,734.

BACKGROUND OF THE INVENTION

1. Field of the Invention

The present invention relates to ridge cap roof ventilators folded from a blank of corrugated plastic sheet material having two vent parts and an intermediate top panel, and particularly to such an assembled roof ventilator that is rolled into a spiral or coiled configuration.

2. Discussion of the Prior Art

The art is relatively well defined relating to ridge cap roof ventilators fabricated from corrugated plastic sheet material and folded to form two vent parts disposed on opposing sides of an opening in a roof peak and an intermediate top panel.

U.S. Pat. No. 4,803,813 to Fiterman and U.S. Pat. Nos. 5,04,041 and 5,331,783 to Kasner describe various methods for scoring, folding, and routing blanks of corrugated plastic sheet material to form the roof vents, as well as their method of installation and use.

These folded roof ventilators and similar designs were traditionally made and sold in lengths of approximately four feet. However, a hinged double-length roof vent was developed as disclosed in U.S. Pat. No. 5,304,095 to Morris which enhanced the shipping and installation of such roof vents.

In comparison, other types of highly flexible roof covering products such as shingles, tar paper, and some roof ventilation products fabricated from open celled foam or other pliable materials are distributed in roll form, which permits longer lengths of product to be installed in one operation without transitions, and eliminates some potentially undesirable features such as seams or gaps.

U.S. patent application Ser. No. 08/570,656 filed on Dec. 11, 1995 discloses a multi-layer, corrugated plastic ridge cap roof ventilator having two opposing vent parts (of the type shown in the Fiterman '813, Morris '095, and Kasner '041 and '783 patents) which is fabricated from a cut and scored blank of double-faced corrugated plastic sheet material that is rolled into a spiral configuration and secured for shipping. The blank is subsequently unrolled, and the scored panels are sequentially folded and secured to the roof to form the opposing vent parts during installation. The roof vent embodiments and fabrication process described in this application increases manufacturing efficiency and substantially reduces waste from trimming and fitting shorter sections of 4' or 8' roof vents, however the process of folding and fastening the roof vents is still time consuming for the installers, and the rolled blanks can sometimes be difficult to carry or handle when climbing a ladder or in windy conditions due to their respective length and width.

It may be appreciated that those skilled in the art have heretofore been required to select between the advantages of assembled multi-layer double-faced corrugated plastic roof ventilators which cannot be rolled, rolled roofing products which do not provide the advantages of a multilayer double-faced corrugated plastic product, or additional steps which must be taken during installation to convert a rolled blank of double-faced corrugated plastic sheet material into an assembled multi-layer roof ventilator.

BRIEF SUMMARY OF THE INVENTION

It is therefore the goal of the present invention to provide an assembled, multi-layer, corrugated plastic ridge cap roof ventilator in which the layers or panels of each vent part are interconnected or secured together in a stacked orientation, and the assembled product is rolled into a spiral configuration for shipping and installation.

Briefly described, the roof vent of this invention comprises a pair of opposing vent parts connected by a top panel—with each vent part being formed from a plurality of layers of double-faced corrugated plastic sheet material that are hingedly connected or fastened to one another in a stacked orientation—which is rolled longitudinally along its length to form a tight spiral or coiled configuration and secured for shipping.

The roof vent is rolled into the spiral configuration by engaging the leading end of a section of the roof vent, passing the generally planar section between a pair of pinch-type tensioning rollers or alternately along a nonlinear path across a plurality of tensioning rollers which cause the section to flex or bend longitudinally, and then rolling the section around a drum or mandrel.

The roof vent is installed by placing the roll on the peak of the roof covering the pre-cut ventilation opening, with the free end of the roll disposed extending over the top of the roll and oriented away from the direction of installation. A length of the section is unrolled and fastened to the roof in a conventional manner. The section is further unrolled and fastened to the roof, with the process continuing until the desired length has been installed. Alternately, the entire length may first be unrolled and then fastened to the roof. Foam end caps and air deflectors may optionally be installed if desired.

The roof vent in spiral or coiled roll form is easier and safer to carry when climbing a ladder or moving about a roof compared with either straight vent sections or the prior rolled vents discussed above, particularly in windy conditions, and the flat toroidal rolls can be stacked or placed "on end" on a moving pallet or an angled roof roll without rolling away.

The rolled roof vent disclosed herein may therefore be fabricated in a substantially continuous and automated process starting with the extrusion of large bulk rolls of single- or double-faced corrugated sheet material, the rolls being fed through the appropriate dies and machinery to cut, trim, score, fold, and fasten the panels to form a continuous web of the folded roof vent, the continuous web being cut into sections of the appropriate length which are rolled into the spiral configuration (or alternately the web may be rolled and sections cut during the rolling process), with the spiral rolls then being labeled and banded or packaged. Such a fabrication process permits the fabrication of sections of roof vent having differing lengths and widths with only minor adjustment or substitutions in the fabrication equipment or machinery.

DETAILED DESCRIPTION OF THE PREFERRED EMBODIMENTS

The apparatus and method of this invention are illustrated in FIGS. 1–5 and referenced generally therein by the numeral 10.

The prior art disclosures relating to the fabrication and structure of roof vents using corrugated plastic sheet material having a convoluted intermediate ply, the nick-scoring and cut-scoring procedures utilized to construct folded roof ventilators, and the various other features, optional components, improvements, and methods of fabrication and use associated with these products are incorporated into this specification by reference as though fully recited herein, including but not limited to the disclosures contained in U.S. Pat. No. 4,803,813 to Fiterman; U.S. Pat. Nos. 5,094,041 and 5,331,783 to Kasner; U.S. Pat. No. 5,304,095 to Morris; and U.S. patent application Ser. Nos. 08/570,656 now U.S. Pat. No. filed on Dec. 11, 1995 relating to a rolled ridge ventilator; 08/127,005 filed on Sep. 24, 1993 relating to an adjustable air deflector for a roof ventilator; and 08/126,307 filed on Sep. 24, 1993 relating to a foam end closure or intermediate support for a roof ventilator and method of making and using the same.

Figure 1:
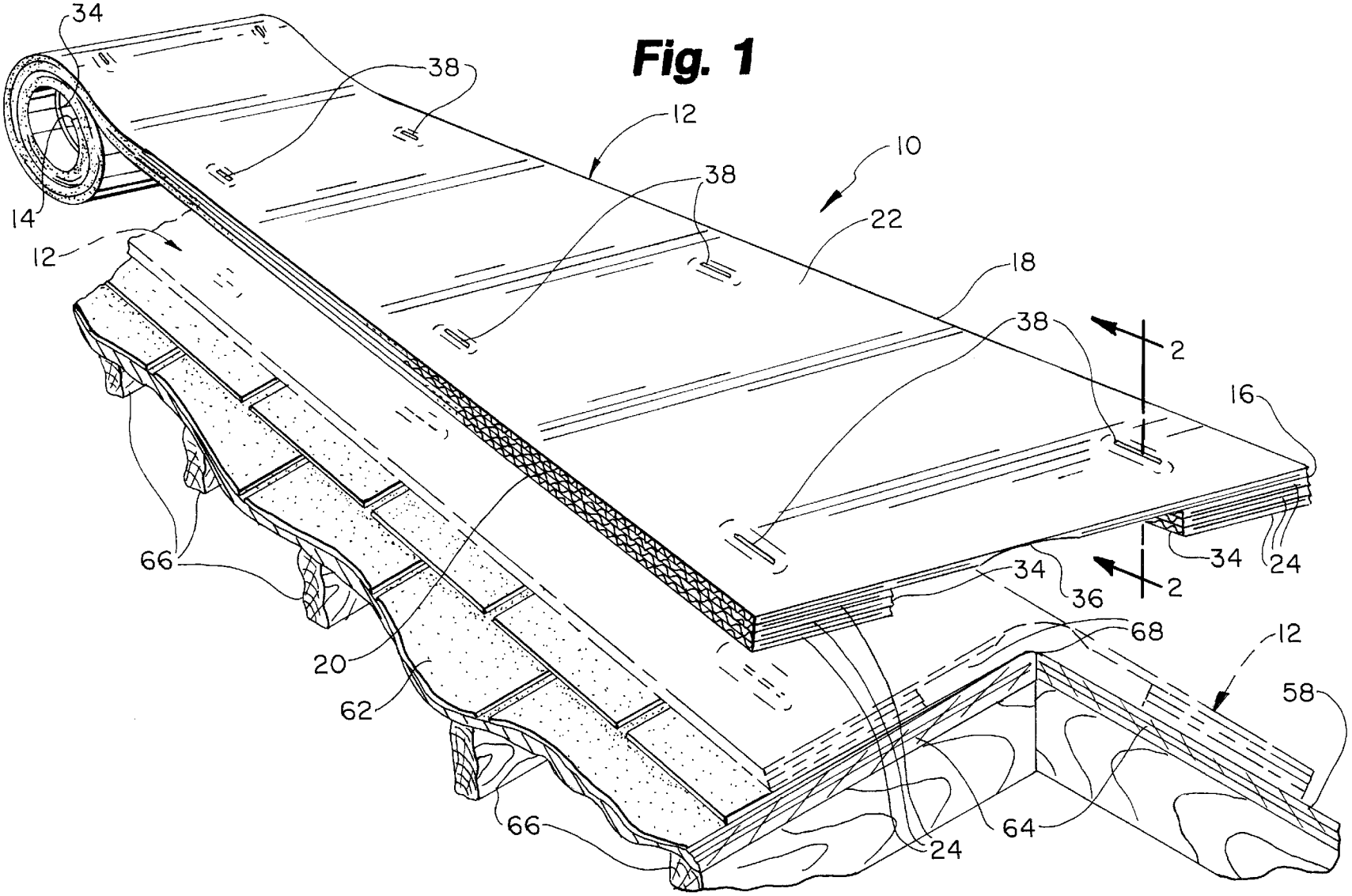
FIG. 1 is a perspective view of the spiral rolled roof vent of this invention being partially installed on the peak of a roof.
Figure 2:
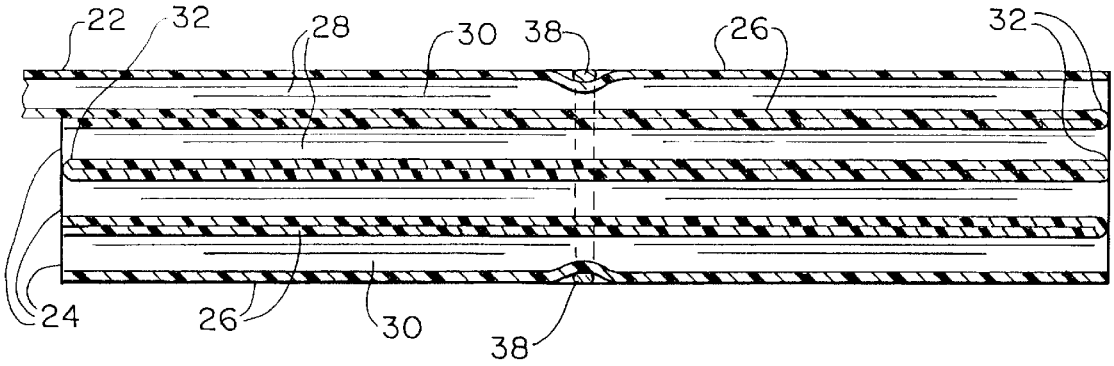
FIG. 2 is a cross sectional view of one vent part and the top panel of the roof vent, taken through line 2—2 in FIG. 1, showing the double-faced corrugated plastic sheet material, hinged interconnections between the panels, and use of a fastener to secure the panels together in a vertically aligned stacked orientation.

While the particular embodiment of the roof vent 10 described herein and shown in FIGS. 1 and 2 is discussed below with particular reference to a three-ply or double-faced corrugated plastic sheet material, it is understood that roof vents 10 of this type and configuration may alternately be fabricated and constructed in the same manner using two-ply or single-faced corrugated plastic sheet material, as well as corrugated sheet materials of other types to the extent they are sufficiently impervious to weather, heat, moisture, decay, and other environmental conditions prevalent in the locations where the roof vents 10 will be installed and used.

Figure 5:
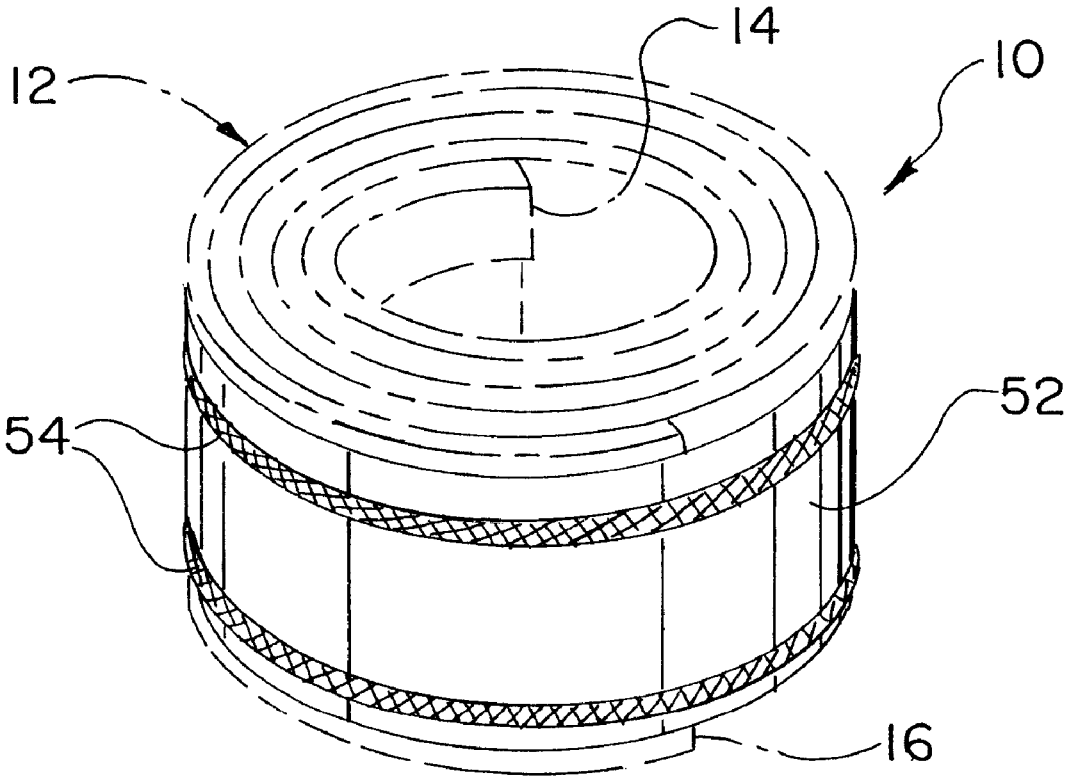
FIG. 5 is a perspective view of the roof vent rolled in a tight spiral or coiled configuration, with a label wrapped about the circumference of the roll, and the roll secured using a pair of bands.

Referring particularly to FIGS. 1 and 5, the rolled roof vent 10 of this invention is shown in its tightly-rolled spiral or coiled configuration for shipping, and in the process of installation. The roof vent 10 is shown as a section 12 having a finite length on the order of 20', however the respective length and width of the section 12 may be readily varied according to the needs of a particular application discussed further below. The section 12 has a leading edge 14 prior to being rolled, a free end 16 after being rolled, and a pair of opposing sides 18, 20 which extend parallel with the longitudinal axis of the section 12 the length of the section 12.

Figure 4:
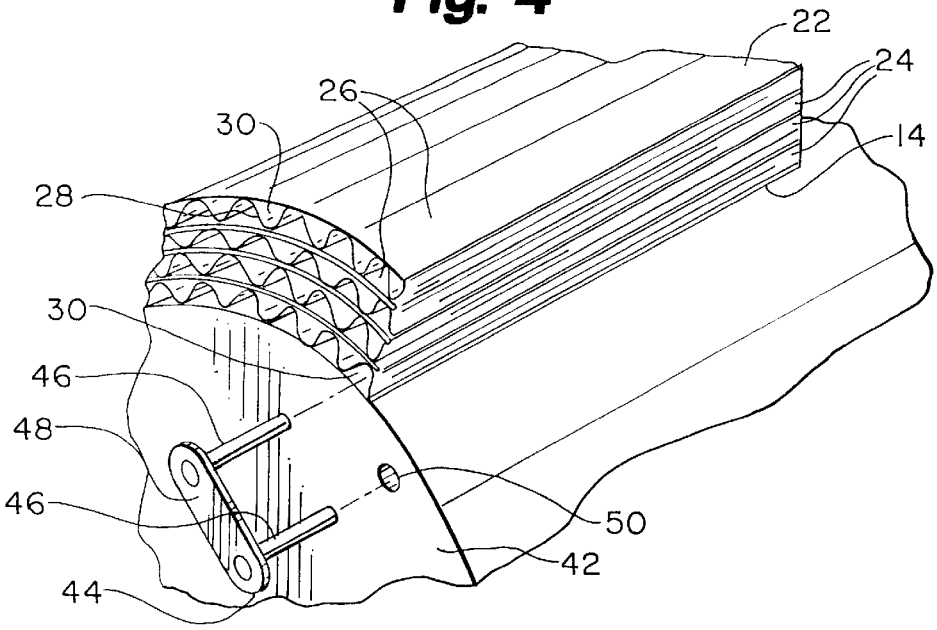
FIG. 4 is a broken away perspective view showing the leading edge of the section of FIG. 3 being engaged by the cylindrical drum, and the multiple layers of double-faced corrugated plastic sheet material forming the panels of one vent part and top panel.

The construction or fabrication of the section 12 from a blank of sheet material is shown in detail in FIG. 2, as well as in FIGS. 1 and 4. The sheet material is an polyethylene plastic, and may include any percentage of recycled plastic resin that is suitable for the intended use. The section 12 defines a top panel 22 that extends in an uninterrupted manner the length of the section 12 generally parallel with and bisected by a longitudinal centerline. Extending from and hingedly connected to the top panel 22 are a plurality of panels 24, with three such panels 24 being shown. The top panel 22 and plurality of panels 24 are preferably fabricated from a double-faced corrugated plastic sheet material having a pair of planar plies 26 connected to a convoluted intermediate ply 28 to create a multiplicity of air passages 30 and a grain extending generally perpendicular to the longitudinal axis of the section 12.

Each panel 24 is hingedly interconnected to the adjacent panels 24 or to the outer edges of the top panel 22 by a hinge member 32 formed by one of the planar plies 26 which is not entirely cut or severed during the cutting and scoring process. The panels 24 are accordion folded into a generally stacked orientation beneath the top panel 22 to form a pair of opposing vent parts 34, in each of which the panels 24 have approximately the same shape and size and the peripheral edges of each are in generally vertical alignment with one another. A center route 36 may be formed into the underside of the top panel 22 in a conventional manner as described in the Kasner '041 patent identified above. The route 36 permits the top panel 22 to be folded or conform to any pitch or angle, as well as rounded peaks, while maintaining a uniform and straight fold or bend. The route 36 permits the top panel 22 to provide additional ventilation. The panels 24 of the opposing vent parts may optionally be cut and scored to form a staggered, tapered, stepped, or other patterns or configurations other than vertical stacked alignment along same-sized concentric peripheral borders. The blank of sheet materials may optionally be fabricated from single-faced corrugated material having a single planar ply attached to a convoluted ply.

Referring to FIGS. 1 and 2, it may be seen that the panels 24 of the vent parts and the top panel 22 are fastened together (at approximately 2' intervals in a 20' section 12) with staples 38 or similar fasteners. It may be appreciated that the vent parts may also be fabricated by cutting entirely through the blank to form a plurality of panels 24 which are separate and disconnected from one another, stacking those panels 24 to form the vent parts, and fastening them together (and to the top panel) in stacked alignment or a staggered pattern to form the vent parts and the roof vent 10. In the preferred embodiment, the panels 24 and top panel 22 are interconnected both by the cut- or nick-scoring process which provides integral hinges 32 between the plurality of panels 22 and the top panel 24, as well as the fasteners 38.

Figure 3:
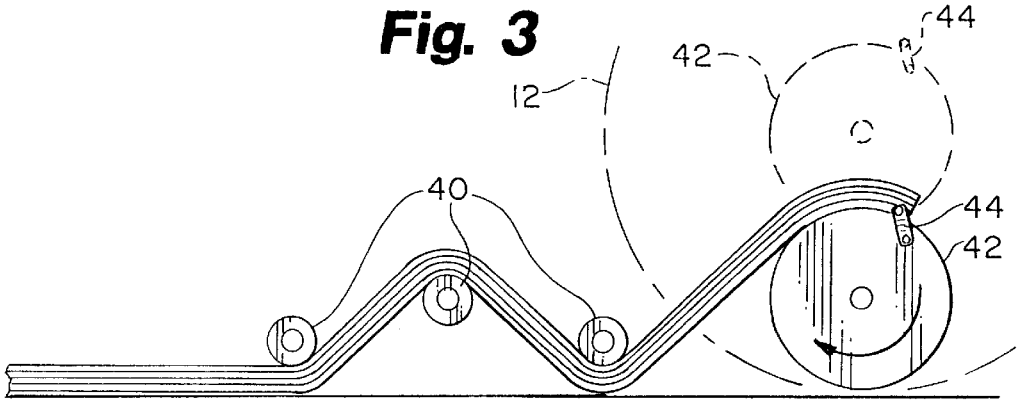
FIG. 3 is a diagrammatic representation of a section of the roof vent being passed along a non-linear path between tensioning rollers and rolled onto a cylindrical drum or mandrel to form a tight spiral.

The process of rolling the section 12 into the spiral configuration is shown diagrammatically in FIGS. 3 and 4. The leading edge 14 of the section 12 is engaged on a generally cylindrical drum 42 in any suitable manner, such as by a bar-type clamp (not shown) which extends parallel with and grips the leading edge 14 of the section 12, U-shaped connectors 44 which are received within the air passages 30 of the section 12, or other types of gripping mechanisms conventionally used with single- or double-faced plastic sheet material.

The pair of generally U-shaped connectors 44 shown in FIGS. 3 and 4 as one of the available gripping mechanisms is suited to corrugated sheet materials, each connector 44 having a pair of prongs 46 and an intermediate bridge 48, one of the prongs 46 being received within an aperture 50 in the side of the drum 42, and the other prong 46 received within and engaging one of the multiplicity of air passages 30 defined by the corrugated sheet material. The prong 46 received within the aperture 50 of the drum 42 may be elongated relative to the other prong 46, and be spring biased toward the midpoint of the drum 42 so that the connector 44 may be pulled laterally away from the drum 42 to disengage the section 12, and biased back into engagement with another section 12 by the spring force.

Referring particularly to FIG. 3, the drum 42 is mounted for rotation in the direction that the section 12 is to be rolled into a spiral configuration, and may be rotated manually or by a suitable motor or drive mechanism (not shown). In addition, the drum 42 is mounted to move upwardly and downwardly between a lower and a raised position, as shown in solid lines and phantom lines, respectively, in FIG. 3. As the drum 42 is rotated and the section 12 rolled onto the drum 42, the drum 42 will rise proportionately, such that the upper or raised position corresponds to a change in height equal to the radial thickness of the roof vent 10 in the rolled configuration, measured between the inner and outer diameters.

The section 12 being rolled is initially passed between a pair of pinch-type tensioning rollers 40 disposed on opposing top and bottom sides of the section 12 which maintain the proper alignment and longitudinal tensioning of the section 12 as it approaches the drum 42, and serves to prevent the trailing end of the section 12 from flipping upwardly or around the drum 42 as it rotates due to natural stiffness or rigidity of the fabricated section 12. The tensioning rollers 40 also exert sufficient rearward tension or force to ensure that the section 12 rolls into a reasonably tight and uniform spiral. Alternately, in situations where the section 12 is especially thick or the corrugated sheet material is particularly stiff or rigid and a suitably tight and uniform spiral roll cannot be achieved using just pinch-type tensioning rollers 40, the section 12 may be passed along a non-linear path between and across a plurality of tensioning rollers 40 disposed above and below the section 12, and onto the drum 42 or mandrel as shown in FIG. 4. In this process, the tensioning rollers bend or flex the section from its normally planar configuration to an angled position, and thereby prepare the section 12 for rolling into a spiral configuration. The tensioning rollers may be disposed to gradually increase the angle of flexure of the section 12, for example the first roller 40 generating an obtuse bend of between 90° and 180°, and the second roller 40 creating a bend of a lesser obtuse angle or approaching or achieving a right or acute angle. Subsequent angles may be the same or progressively sharper, depending upon the thickness of the section, stiffness of the corrugated sheet material, the engagement between the panels 24 and top panel 22, and the eventual diameter of the spiral to be formed.

It will be readily appreciated by those skilled in the art that the weight of the drum 42, the rotational force or torque exerted on the section 12 by the drum 42, the longitudinal tension applied by the tensioning rollers 40, the spacing of the tensioning rollers 40 and the non-linear path and angles of flexure formed therebetween, and the angular velocity of the drum 42 will depend upon the thickness and stiffness of the section 12, which in turn depends upon the particular construction and materials utilized. It has proven suitable to roll a 20' section 12 constructed using nick-scored accordion folded panels 24 stapled along the center of each vent part at 2' intervals having a thickness of ⅝" into a tight spiral on an approximately 12" diameter drum 42. It should be noted that to produce a uniform tight spiral without significant creases or puckers, it is important to maintain generally uniform longitudinal tension along each side edge 18, 20 of the section 12 as the section 12 traverses the non-linear path, at least through the last few or final pair of tensioning rollers 40.

Once the section 12 has been rolled into the tight spiral as shown in FIG. 5, a label 52 or other placard may be wrapped around a portion of the roof vent 10, and the roof vent 10 may be secured in the spiral configuration for shipping or storage using a pair of welded plastic bands 54 or similar fasteners. The roof vent may also be shrink-wrapped, taped, or secured in any other suitable manner. Labeling information may optionally be printed or applied directly to the outer surface of the rolled roof vent 10.

It may be readily appreciated that the length of the section 12 may vary anywhere between a minimum length shorter than which it would not be practical to roll the section 12 into a spiral configuration to facilitate transport or storage, and a maximum length beyond which the spiral roll 10 could not practically be carried, lifted, or handled by a worker installing the roof vent 10 on a roof 58. However, in some applications (such as buildings having very long peaks or adjacent buildings having commonly aligned peaks) it may be suitable to fabricate extremely large spiral rolls 10 which are lifted to the roof 58 and deployed using mechanical assistance, such as a fork lift or boom crane. It may also be appreciated that the roof vent 10 may be fabricated in a variety of widths, thicknesses, and other dimensional variances.

Referring again to FIG. 1, the method of installing the roof vent 10 is shown. The installation site provides a house or other building structure having a generally peaked roof 58 defining a ridge opening 60 extending therethrough for ventilation. All or a portion of the roof 58 may be covered with shingles 62, and the roof 58 will usually include planar underlayment 64 supported by joists 66 and a central beam (not shown).

The rolled roof vent 10 is placed on top of the peak of the roof 58 with the free end 16 extending across the top of the roll and oriented facing the end of the roof 58, or conversely facing away from the direction of installation. When viewed from the side elevation, the rolled roof vent 10 will have a free end 16 extending over the top of the roll 10 when the direction of installation is from right to left and the spiral of the roll 10 has a counter-clockwise orientation, as shown in FIG. 1. In this manner, the rolled roof vent 10 may be handled and installed by one individual without the roll 10 inadvertently unrolling as sequential portions of the section 12 are unrolled and secured to the roof.

The free end 16 of the rolled roof vent 10 is positioned adjacent the edge of the roof 58 or at another desired starting point with the roll disposed above the roof opening 60, and the section 12 is then unrolled a short distance along the peak of the roof 58 to feed or expose a manageable portion, as shown in FIG. 1. The free end 16 of the section 12 is then fastened to the roof 58 in a conventional manner using fasteners (not shown) such as nails or staples, and an intermediate portion between the fee end 16 and the roll may similarly be secured to the roof 58.

The section 12 is then further unrolled to expose another subsequent portion of the section 12, which is similarly secured to the roof 58. This process is repeated until the desired or entire length of the section 12 has been unrolled and secured to the roof 34. Any excess length of the section 12 may be but away and discarded or used on a separate section of the roof 58. It may be appreciated that the roof vent 10 is generally very flexible across the centerline of the top panel 22, but a sufficient length of the section 12 may need to be unrolled to allow enough distance or clearance from the remaining portion of the roll to permit the top panel 22 to be flexed or bent so that the vent parts will contact the roof 58.

Alternately, the entire section 12 may be unrolled onto the peak of the roof 58 at one time, generally aligned along the ridge or peak of the roof 58, and then folded across the peak of the roof 58 and secured to the roof 58 using fasteners in a conventional manner traversing progressively from one end of the section 12 to the other.

Foam end caps 68 or intermediate supports and adjustable air deflectors (not shown) may optionally be installed in a conventional manner if desired, either during or subsequent to the installation of the rolled roof vent 10. A pair of the foam end caps 68 which conform to the shape or pitch of the roof 58 may be packaged between wrapped layers of the rolled vent 10, and additional foam segments 68 may be included if intermediate support for the top panel 22 may be desired in a particular application. More than one section 12 of the roof vent 10 may be butted together with no special fasteners or connectors, or an installer may prefer to adhere the foam end caps 68 into each of the adjacent abutting sections 12 and then adhere or caulk the end caps 68 and corresponding abutting portions of the top panels 22 together to provide a moisture-proof or leak-resistant seal.

Although the present invention has thus been described in detail with reference to the preferred embodiments for practicing that invention, other embodiments, modifications, alterations, or substitutions deemed within the spirit and scope of the present invention may suggest themselves to those skilled in the art depending upon the particular applications involved. It is therefore intended that the present invention be limited only by the properly attributable scope of the attached claims below.

What is claimed is:

1. A roof ventilator fabricated from a corrugated plastic sheet material, said corrugated plastic sheet material having a pair of generally planar plies and a generally convoluted ply defining a grain, said roof ventilator comprising:

a plurality of panels formed from the corrugated plastic sheet material, said plurality of panels being generally stacked and connected to one another to form a vent section, said vent section having a longitudinal axis, said vent section being rolled in a direction generally parallel with said longitudinal axis so as to define a generally spiral configuration.

2. The roof ventilator of claim 1 wherein the longitudinal axis is oriented generally perpendicular to the grain.

3. The roof ventilator of claim 1 wherein the plurality of panels are defined by a blank cut and scored from the corrugated plastic sheet material, the plurality of panels being hingedly interconnected with one another along one or more hinge lines and folded relative to one another across said hinge lines to form the vent section.

4. The roof ventilator of claim 3 wherein the hinge lines are cut lines extending partially through the corrugated plastic sheet material.

5. The roof ventilator of claim 4 wherein the cut lines are generally perpendicular to the grain.

6. The roof ventilator of claim 4 wherein the cut lines extend entirely through the at least one planar ply, but not entirely through the generally convoluted ply.

7. The roof ventilator of claim 3 wherein the plurality of panels in the vent section are secured to one another with one or more fasteners.

8. The roof ventilator of claim 1 wherein the plurality of panels in the vent section are secured to one another with one or more fasteners.

9. The roof ventilator of claim 1 wherein the corrugated plastic sheet material is a double-faced construction defining a multiplicity of generally parallel air passages and including a first planar ply and a second planar ply spaced apart from said first planar ply, the generally convoluted ply disposed between and connected to both said first planar ply and said second planar ply.

10. The roof ventilator of claim 1, wherein each of the plurality of panels has a planar face, and wherein each of the plurality of panels are stacked in a generally aligned relationship, such that each said planar face of the plurality of panels is oriented generally parallel with one another.

11. The roof ventilator of claim 1, wherein the plurality of panels each has a peripheral boundary, said peripheral boundary of each of the plurality of panels having a portion which is generally coextensive with one another in shape and size, and wherein the plurality of panels are stacked such that said portions of said peripheral boundaries of the plurality of panels are generally aligned in a radial relationship with one another.

12. A roof ventilator fabricated from a corrugated plastic sheet material, said corrugated plastic sheet material having a pair of generally planar plies and a generally convoluted ply defining a grain, said roof ventilator comprising:

a first plurality of panels formed from the corrugated plastic sheet material, said first plurality of panels being generally stacked and connected to one another to form a first vent section, said first vent section having a longitudinal axis;

a second plurality of panels formed from the corrugated plastic sheet material, said second plurality of panels being generally stacked and connected to one another to form a second vent section, said second vent section being oriented generally parallel with said longitudinal axis of said first vent section; and a top panel extending between and connected to both said first vent section and said second vent section, said first vent section, said second vent section, and said top panel being rolled in a direction generally parallel with said longitudinal axis so as to define a generally spiral configuration.

13. The roof ventilator of claim 12 wherein the first plurality of panels in the first vent section are secured to one another with one or more fasteners and wherein the second plurality of panels in the second vent section are secured to one another with one or more fasteners.

14. The roof ventilator of claim 12 wherein the first plurality of panels, the second plurality of panels, and the top panel are all defined by a blank cut and scored from the corrugated plastic sheet material, the first plurality of panels being hingedly interconnected with one another along one or more hinge lines and folded relative to one another across said hinge lines to form the first vent section, the second plurality of panels being hingedly interconnected with one another along one or more hinge lines and folded relative to one another across said hinge lines to form the second vent section, and the first plurality of panels and the second plurality of panels each being hingedly connected to the top panel.

15. A method for fabricating a roof ventilator from a corrugated plastic sheet material, said corrugated plastic sheet material having a pair of generally planar plies and a generally convoluted ply defining a grain, said method comprising the steps of:

providing a plurality of panels of the corrugated plastic sheet material;

stacking said plurality of panels to form a vent section, said vent section having a longitudinal axis; and rolling said vent section in a direction generally parallel with said longitudinal axis so as to define a generally spiral configuration.

16. The method of claim 15 wherein the vent section has a first end, and wherein the step of rolling the vent section to define the generally spiral configuration further comprises the steps of:

providing a drum onto which the vent section is rolled to define the generally spiral configuration;

engaging the first end of the vent section to said drum such that rotation of said drum will apply tension to said first end of the vent section; and rotating said drum to roll the vent section onto said drum so as to define the generally spiral configuration.

17. The method of claim 15 wherein after the step of stacking the plurality of panels the method further comprises the step of:

connecting the plurality of panels to one another with a plurality of fasteners.

18. The method of claim 17 wherein the step of connecting the plurality of panels to one another with the plurality of fasteners includes stapling the plurality of panels together at increments along the vent section.

19. The method of claim 15 wherein the plurality of panels are hingedly interconnected to one another along fold lines, and further wherein the step of stacking the plurality of panels includes folding the plurality of panels across said fold lines.

20. The method of claim 19 wherein after the step of stacking the plurality of panels the method further comprises the step of:

connecting the plurality of panels to one another with a plurality of fasteners.

21. The method of claim 20 wherein the step of connecting the plurality of panels to one another with the plurality of fasteners includes stapling the plurality of panels together at increments along the vent section.

22. A roof ventilator, comprising:

a plastic material with a pair of generally planar first plies and a second ply, the first and second plies joined such that a multiplicity of air passages is defined thereby, the air passages extending generally transversely to a longitudinal axis of the roof ventilator, the roof ventilator conformable to a spiral conformation by being rolled in a direction generally parallel to the longitudinal axis, the roof ventilator further conformable to a ridge of a roof.

23. The plastic material of claim 22, further comprising a third ply, the third ply joined to the second ply such that additional air passages are defined thereby.

24. The plastic material of claims 23, in which the second ply is generally convoluted.

25. The plastic material of claim 23, in which the second ply includes a multiplicity of generally perpendicular beams.

26. The roof ventilator of claim 22, further comprising a plurality of first plastic panels, each first panel formed such that a multiplicity of first air passages is defined thereby, the first air passages with longitudinal axes extending generally transversely to a longitudinal axis of the first panel, the plurality of first panels conformable to a spiral configuration by being rolled in a direction generally transverse to the longitudinal axes of the first air passages.

27. The roof ventilator of claim 26, further comprising a second plastic panel, a lower surface of the second panel connectable to the plurality of first panels proximate a first lateral edge thereof, the second panel formed such that a multiplicity of second air passages is defined thereby, the second air passages generally parallel to the first air passages, the second panel and the first panels conformable to a spiral configuration by being rolled together in a direction generally transverse to longitudinal axes of the first air passages.

28. The roof ventilator of claim 27, further comprising a plurality of third plastic panels connectable to the second panel proximate a second lateral edge of the lower surface of the second panel, each third panel formed such that a multiplicity of third air passages is defined thereby, the third air passages generally parallel to the first air passages, the first panels, the second panel and the third panels conformable to a spiral configuration by being rolled together in a direction generally transverse to the longitudinal axes of the first air passages.

29. The roof ventilator of claim 28, in which the roof ventilator is in a rolled conformation.

30. The roof ventilator of claim 28, in which the plastic material includes a third ply joined to the second ply such that additional air passages are defined thereby.

31. The roof ventilator of claim 30, in which said second ply is generally convoluted.

32. The roof ventilator of claim 30, in which said second ply includes a multiplicity of generally perpendicular beams.

33. The roof ventilator of claim 22, in which the plastic material includes polyethylene.

34. The roof ventilator of claim 22, in which the plastic material includes recycled plastic resin.

35. The roof ventilator of claim 30, in which each first panel is connected to another first panel and in which each second panel is connected to another second panel.

36. The roof ventilator of claim 35, in which the first and second panels are stacked.

37. The roof ventilator of claim 36, in which each first and second panel has an exterior lateral edge, in which the first panels are stacked such that the exterior lateral edges of the first panels are generally aligned with the first lateral edge of the second panel, and in which the second panels are stacked such that the exterior lateral edges of the second panels are generally aligned with the second lateral edge of the second panel.

38. The roof ventilator of claim 36, in which the first and second panels are interconnected by connection devices selected from the group consisting of a fastener, means for hingedly interconnecting the panels, at least one common ply, and a combination thereof.

39. The roof ventilator of claim 38, in which the fastener is selected from the group consisting of a staple, a nail, a flexible and foldable connector and a combination thereof.

40. The roof ventilator of claim 39, in which the fasteners are emplaced a distance apart from each other, said distance being about ten percent of a total length of said roof ventilator.

41. The roof ventilator of claim 39, in which the fasteners are spaced apart at intervals of about two feet.

42. The roof ventilator of claim 38, in which the hingedly interconnecting means is selected from the group consisting of slit scoring, nick scoring, and a combination thereof.

43. The second panel of claim 30, in which the third ply defines the lower surface of the second panel and in which a generally linear portion of the third ply and at least a portion of the second ply underlying the third ply are removed, thereby defining a route, the route being generally parallel to a longitudinal axis of the second panel and defining interior openings of the second air passages.

44. The second panel of claim 43, in which the route is generally coaxial to the longitudinal axis of the second panel.

45. The second panel of claim 43, in which the route is generally arcuate in cross section.

46. The roof ventilator of claim 30, further comprising means for retaining said roof ventilator in said spiral configuration.

47. The roof ventilator of claim 46, wherein said retaining means includes a plastic band.

48. A ventilator for enabling air exchange between the interior and the exterior of a roof, the ventilator made from a plastic material with a first and a second generally planar ply and a generally convoluted ply disposed between said planar plies, said planar plies and said convoluted ply joined so as to define a multiplicity of air passages, the roof ventilator comprising:

generally rectangular first and second vents, each vent including a plurality of stacked, hingedly interconnected panels formed from the plastic material;

a generally rectangular top panel formed from the plastic material, the top panel with a lower side defined by the first planar ply, the top panel having a coaxial arcuate route defined by removing a generally linear portion of the first planar ply, the arcuate route further defined by removal of at least a portion of the convoluted ply underlying the removed planar ply, the top panel hingedly connected to an upper panel of each vent proximate each lateral edge of the top panel such that longitudinal axes of both vents are generally parallel to a longitudinal axis of the top panel, the top panel further attached to each vent by a multiplicity of fasteners extending through the top panel and each panel of each vent, the air passages defined in each vent and in the top panel extending generally perpendicularly to the longitudinal axis of the top panel, the top panel and attached vents conformable to a spiral by being rolled in a direction generally parallel to the longitudinal axis of the top panel.

49. The ventilator of claim 48, in which the ventilator is in a spiral conformation.

50. The ventilator of claim 48, in which the convoluted ply includes a multiplicity of beams extending between and generally transverse to the planar plies.

51. A method of fabricating a roof ventilator, the roof ventilator conformable to the ridge of a roof, the method comprising the steps of:

providing a plastic sheet material, the plastic sheet material including a pair of generally planar plies and a convoluted ply joined so as to define a multiplicity of air passages therebetween, the air passages extending so as to define a grain;

defining a top panel and two vents in the plastic sheet such that the grain extends generally transversely to a longitudinal axis of the top panel, each vent including a plurality of vent panels extending from each lateral edge of the top panel; and rolling the top panel and the vent panels in a direction generally transverse to the grain.

52. The method of claim 51, the sheet material including two planar plies and a convoluted ply and the defining step including scoring alternate planar plies as adjacent vent panels are defined.

53. The method of claim 51, the sheet material including two planar plies and a multiplicity of generally perpendicular beams extending between the planar plies and the defining step including scoring alternate plies as adjacent vent panels are defined.

54. The method of claim 52, further comprising the steps of:

accordion-folding the vent panels, thereby forming the two assembled vents; and inserting a fastener through the top panel and folded vent panels.

55. The method of claim 54, further comprising the steps of:

affixing a leading edge of the ventilator to a drum;

applying a resistance tension to the affixed ventilator;

rotating the drum, thereby winding a length of the ventilator thereon; and securing the free end of the ventilator to the wound ventilator.

56. The method of claim 55, further comprising the step of passing a portion of the ventilator through a nonlinear path defined by a plurality of tensioning rollers before the portion is wound on the drum, thereby flexing the portion.

57. The method of claim 51, the defining step including cutting completely through both planar plies in a plurality of aligned sections.

58. The method of claim 51, the defining step including cutting completely through both planar plies, thereby completely separating the vent panels and further including the steps of:

stacking the separated vent panels proximate each lateral edge of the top panel; and installing a fastener through the top panel and each vent panel in a vent.

59. The method of claim 51, further comprising the step of emplacing retaining means about said rolled top and vent panels.

60. A method of installing a ventilator on a roof with a ridge, comprising the steps of:

providing a roof ventilator section in a rolled configuration, the roof ventilator section made from a plastic material, the plastic material including a pair of generally planar plies and a convoluted ply joined such that a multiplicity of air passages is formed thereby, the roof ventilator section including a top panel and a vent proximate each lateral side of the top panel, each vent including a plurality of vent panels;

unrolling at least a portion of the roof ventilator section along a ridgeline of the roof; and affixing the unrolled roof ventilator section to the roof such that the ridge is disposed between the vents.

61. The method of claim 60, further comprising the step of unrolling another portion of the roof ventilator section.

62. The method of claim 60, in which the top panel and the vent panels are hingedly interconnected and further comprising the step of folding the vent panels under the top panel, thereby defining two vents.

* * * * *

UNITED STATES PATENT AND TRADEMARK OFFICE

CERTIFICATE OF CORRECTION

PATENT NO. : 5,934,995

DATED : 8/10/99

INVENTOR(S) : Morris, et al.

It is certified that error appears in the above-identified patent and that said Letters Patent is hereby corrected as shown below:

On the title page, item [54], and column 1, line 4, should read

--RIDGE CAP ROOF VENTILATOR APPLIED IN ASSEMBLED ROLLED FORM AND METHOD OF MAKING AND INSTALLING SAME--.

Signed and Sealed this

Fourth Day of July, 2000

*Attest:*

Q. TODD DICKINSON

*Attesting Officer*

*Director of Patents and Trademarks*